US007918657B2

(12) United States Patent
Bobo et al.

(10) Patent No.: US 7,918,657 B2
(45) Date of Patent: Apr. 5, 2011

(54) HEAD FOR A PERISTALTIC PUMP WITH GUIDE AND ROLLER CLAMP ARRANGEMENT

(76) Inventors: Marion H. Bobo, Hickory, NC (US); Michael M. Brown, Ozark, MO (US)

( * ) Notice: Subject to any disclaimer, the term of this patent is extended or adjusted under 35 U.S.C. 154(b) by 795 days.

(21) Appl. No.: 11/909,182

(22) PCT Filed: Apr. 7, 2006

(86) PCT No.: PCT/US2006/012950

§ 371 (c)(1),
(2), (4) Date: Sep. 20, 2007

(87) PCT Pub. No.: WO2006/110510

PCT Pub. Date: Oct. 19, 2006

(65) Prior Publication Data

US 2009/0263256 A1 Oct. 22, 2009

Related U.S. Application Data

(60) Provisional application No. 60/668,964, filed on Apr. 7, 2005.

(51) Int. Cl.
*F04B 43/12* (2006.01)
*F04B 45/08* (2006.01)
*F16C 19/02* (2006.01)

(52) U.S. Cl. ..... 417/477.3; 384/548; 384/609; 417/53

(58) Field of Classification Search ..... 417/477.3, 417/477.1, 477.2, 477.4, 477.5, 477.7, 477.8, 417/477.9, 53; 384/565, 548, 609
See application file for complete search history.

(56) References Cited

U.S. PATENT DOCUMENTS

| | | | | | |
|---|---|---|---|---|---|
| 1,947,392 | A | * | 2/1934 | Wilhelm et al. | 52/108 |
| 1,984,274 | A | * | 12/1934 | Chester | 254/417 |
| 3,602,492 | A | * | 8/1971 | Petrie | 269/296 |
| 4,138,205 | A | | 2/1979 | Wallach | |
| 4,201,525 | A | * | 5/1980 | Brown et al. | 417/477.5 |
| 4,231,725 | A | | 11/1980 | Hogan | |
| 4,441,867 | A | | 4/1984 | Berelson | |
| 4,518,327 | A | * | 5/1985 | Hackman | 417/477.3 |
| 4,552,516 | A | | 11/1985 | Stanley | |
| 4,573,887 | A | * | 3/1986 | Smith | 417/477.1 |
| 4,720,249 | A | * | 1/1988 | Krebs et al. | 417/477.8 |

(Continued)

FOREIGN PATENT DOCUMENTS

DE 2162998 A1 6/1973

(Continued)

*Primary Examiner* — Devon C Kramer
*Assistant Examiner* — Nathan Zollinger
(74) *Attorney, Agent, or Firm* — Hammer & Associates, P.C.

(57) ABSTRACT

A head for a peristaltic pump that may be used for delivering ink to a flexographic printing press includes a housing and a roller assembly. The housing is adapted to receive a flexible tube. The housing has a curved wall and a clamp. The clamp secures the flexible tube within the housing. The roller assembly is rotatable within the housing. The roller assembly includes at least two compression rollers and at least one guide roller. The guide rollers are peripherally spaced between the compression rollers where each of them comes into contact with the flexible tube during rotation of the roller assembly. The guide rollers guide the flexible tube to stay centered with the compression rollers and initiate decompression of the flexible tube to return to a partial compression dimension. Fluid is moved through the flexible tube by rotation of the roller assembly.

18 Claims, 5 Drawing Sheets

U.S. PATENT DOCUMENTS

| | | | | | |
|---|---|---|---|---|---|
| 4,834,630 | A | | 5/1989 | Godwin | |
| 4,925,376 | A | * | 5/1990 | Kahler | 417/477.11 |
| 5,064,358 | A | | 11/1991 | Calari | |
| 5,213,037 | A | | 5/1993 | Leopardi, II | |
| 5,249,938 | A | * | 10/1993 | Hall | 417/477.3 |
| 5,367,982 | A | | 11/1994 | DeMoore et al. | |
| 5,380,173 | A | | 1/1995 | Hellstrom | |
| 5,387,088 | A | | 2/1995 | Knapp et al. | |
| 5,449,154 | A | * | 9/1995 | Lob | 254/394 |
| 5,620,313 | A | | 4/1997 | Fockenberg | |
| 5,630,711 | A | | 5/1997 | Luedtke | |
| 5,683,508 | A | | 11/1997 | Bleiler et al. | |
| 6,041,709 | A | | 3/2000 | Wells et al. | |
| 6,085,652 | A | | 7/2000 | Deschner et al. | |
| 2008/0213113 | A1 | * | 9/2008 | Lawrence et al. | 417/476 |
| 2009/0129944 | A1 | * | 5/2009 | Stemple et al. | 417/53 |

FOREIGN PATENT DOCUMENTS

| | | | | |
|---|---|---|---|---|
| DE | 4315648 | A1 | * | 11/1994 |

* cited by examiner

HEAD FOR A PERISTALTIC PUMP WITH GUIDE AND ROLLER CLAMP ARRANGEMENT

RELATED APPLICATION

This application claims the benefit of U.S. Provisional Application Ser. No. 60/668,964 filed Apr. 7, 2005.

FIELD OF INVENTION

The instant application relates to a head for a peristaltic pump.

BACKGROUND OF THE INVENTION

A peristaltic pump is a type of positive displacement pump used for pumping a variety of fluids. The fluid is contained within a flexible tube fitted inside a head with a circular casing. A rotor within the head, with at least two rollers attached to the external circumference of the rotor, compresses the flexible tube against the circular casing. As the rotor turns, the part of tube under compression closes, forcing the fluid to move through the tube. As the tube opens to its natural state after the passing of the roller, restitution fluid flow is induced to the pump.

In a peristaltic pump, the only part of the pump in contact with the fluid being pumped is the interior of the tube. This eliminates the possibility for contamination getting into the fluid and makes it is easy to clean the inside surfaces of the pump. Furthermore, since there are no moving parts in contact with the fluid, peristaltic pumps are inexpensive to manufacture. Their lack of valves, seals and glands makes them comparatively inexpensive to maintain, and the use of a hose or tube makes for a relatively low-cost maintenance item compared to other pump types.

Peristaltic pumps are mainly used to pump clean or sterile fluids because the pump cannot contaminate the fluid. Peristaltic pumps can also be used to pump aggressive fluids because the fluid cannot contaminate the pump. Therefore, peristaltic pumps should be used where isolation of the fluid from the pump and the environment, and/or isolation of the pump from the fluid, is critical.

The Flexography industry has quickly adapted the use of peristaltic pumps for many reasons. When used in a flexographic printing press, a peristaltic pump is more economical, provides faster cleaning times, wastes fewer printing inks, and contaminates fewer printing inks. In a flexographic printing press, the ink needs to be isolated from the pump and its environment to be free of contaminates in order to function properly in printing. The ink also needs to be isolated from the pump to keep the pump functional and clean. Thus, a peristaltic pump is ideal for a flexographic printing press.

Some prior art patents that show a peristaltic pump head used in the Flexography printing industry include: U.S. Pat. No. 6,041,709, issued to Wells on Mar. 28, 2000, Inc.; U.S. Pat. No. 5,630,711 issued to Luedtke on May 20, 1997; and U.S. Pat. No. 4,552,516 issued to Stanley on Nov. 12, 1985.

There are many problems with the current peristaltic pump head when used in moving a fluid or delivering ink to a flexographic printing press. The peristaltic pump heads consist of plastics and other materials, which cause constant material failures when used in moving fluids in the flexographic printing environment or any environment. These failures of materials are a very expensive cost because they require maintenance and slow down production with more pump downtime. This type of pump operation is very costly to the Flexography industry where cleaning and down time is a major part of the Flexography industry cost. The current designs are very expensive when designed as heavy industry systems to overcome these failures. These systems take up a great deal of space, require periodic maintenance and are not operator friendly.

Current peristaltic pump heads may include adjustment fixtures, occlusion knobs, bladders, and other things which are attempts to prolong tube life. These things are inadequate and do not solve many problems encountered with the tube, including: the cumbersome loading and adjusting of the tube (requiring the use of tools to adjust and load the tube), tube fatigue (from the tube being compressed repeatedly) which wears down the tube and lowers the expected tube life, tube creep (the tube becomes off centered with the rollers due to hydraulic forces caused by peristalsis) which causes additional wearing down of the tube, and tube bunching or gathering at the exit of the pump head (caused from the tube being stretched towards the exit from the rollers) which causes additional wearing down of the tube and can lead to tube rupture when used for several hours of operation. These problems lead to constant tube failures and require frequent replacement of the tube. The replacement of peristaltic pump tubes in existing pumps is a difficult and time consuming procedure which forces excess down time in the Flexography printing industry.

Accordingly, an object of this invention is to address all of these problems.

In particular, the aim of the present invention is to provide a peristaltic pump head which allows easy loading of the tube, a pump head with simple parts that are easy to manufacture and maintain, and a pump head that promotes long life for the pumping tube. The present invention will allow a peristaltic pump which is characterized by its simplicity, durability, low cost to the industry, and ease of manufacturing, servicing and versatility.

SUMMARY OF THE INVENTION

The instant invention is a head for a peristaltic pump. The head includes a housing and a roller assembly. The housing is adapted to receive a flexible tube. The housing has a curved wall and a clamp. The clamp secures the flexible tube within the housing. The clamp has an open position and a closed position. The clamp is in the open position when the flexible tube is able to move through an entrance and exit in the housing. The clamp is in the closed position where a first section of the flexible tube is secured in the entrance and a second section of the flexible tube is secured in the exit. The first and second sections are secured where they are not able to be pulled into the housing but are able to slip out of the housing allowing the head to pump in both directions. The roller assembly is rotatable within the housing. The roller assembly rotates about an axis through the housing. The axis is coaxial to the curved wall in the housing. The roller assembly includes at least two compression rollers and at least one guide roller. The compression rollers are peripherally spaced where each of them come successively into contact with the flexible tube during rotation of the roller assembly. Successive compression rollers compress two portions of the flexible tube against the curved wall to confine a finite volume of fluid in the flexible tube. The guide rollers are peripherally spaced between the compression rollers where each of them comes into contact with the flexible tube during rotation of the roller assembly. The guide rollers guide the flexible tube to stay centered with the compression rollers and initiate decompression of the flexible tube to return to a partial compression dimension. Fluid is moved through the flexible tube by rotation of the roller assembly.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
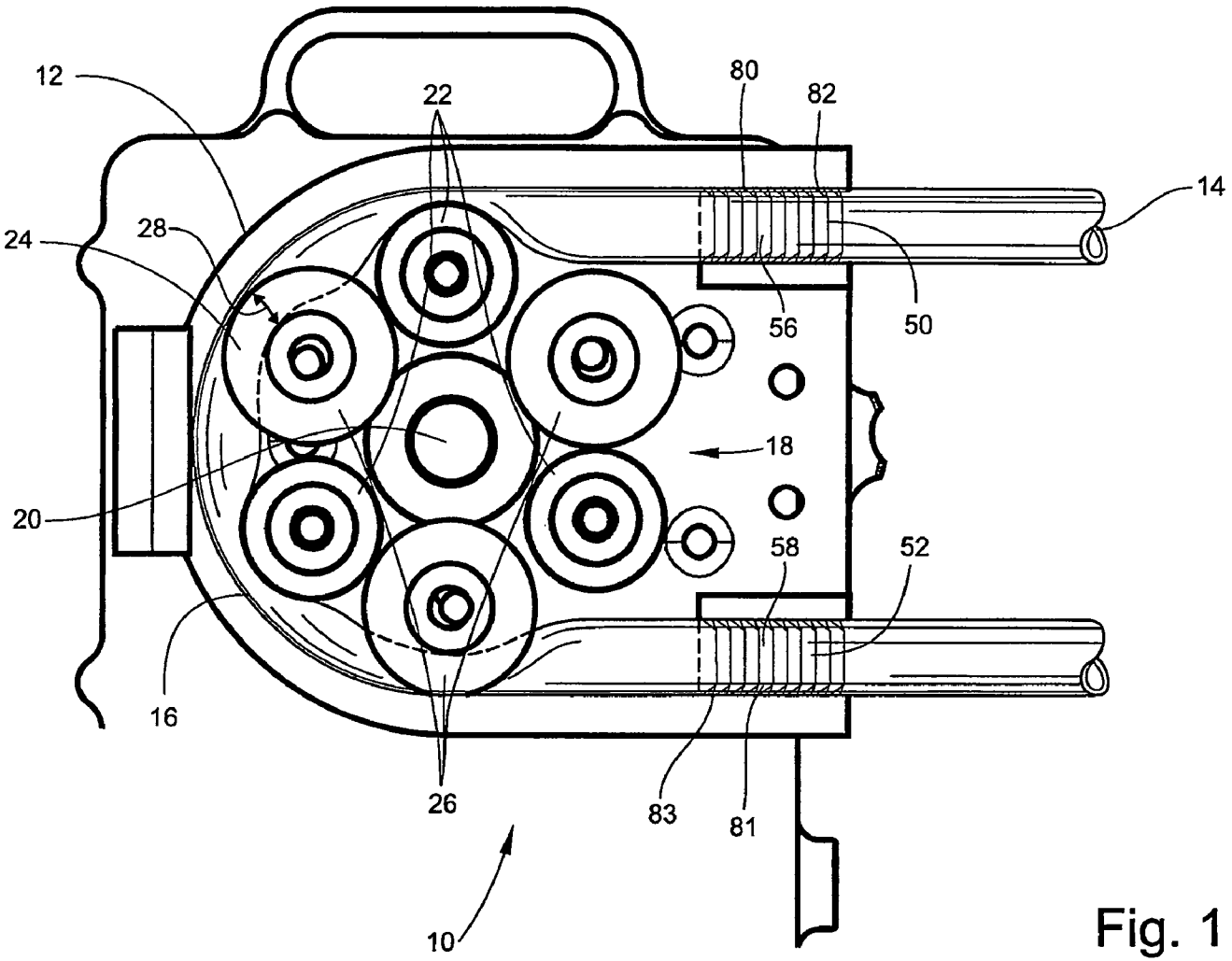
FIG. 1 is a cross-sectional view of one embodiment of the head.
Figure 3:
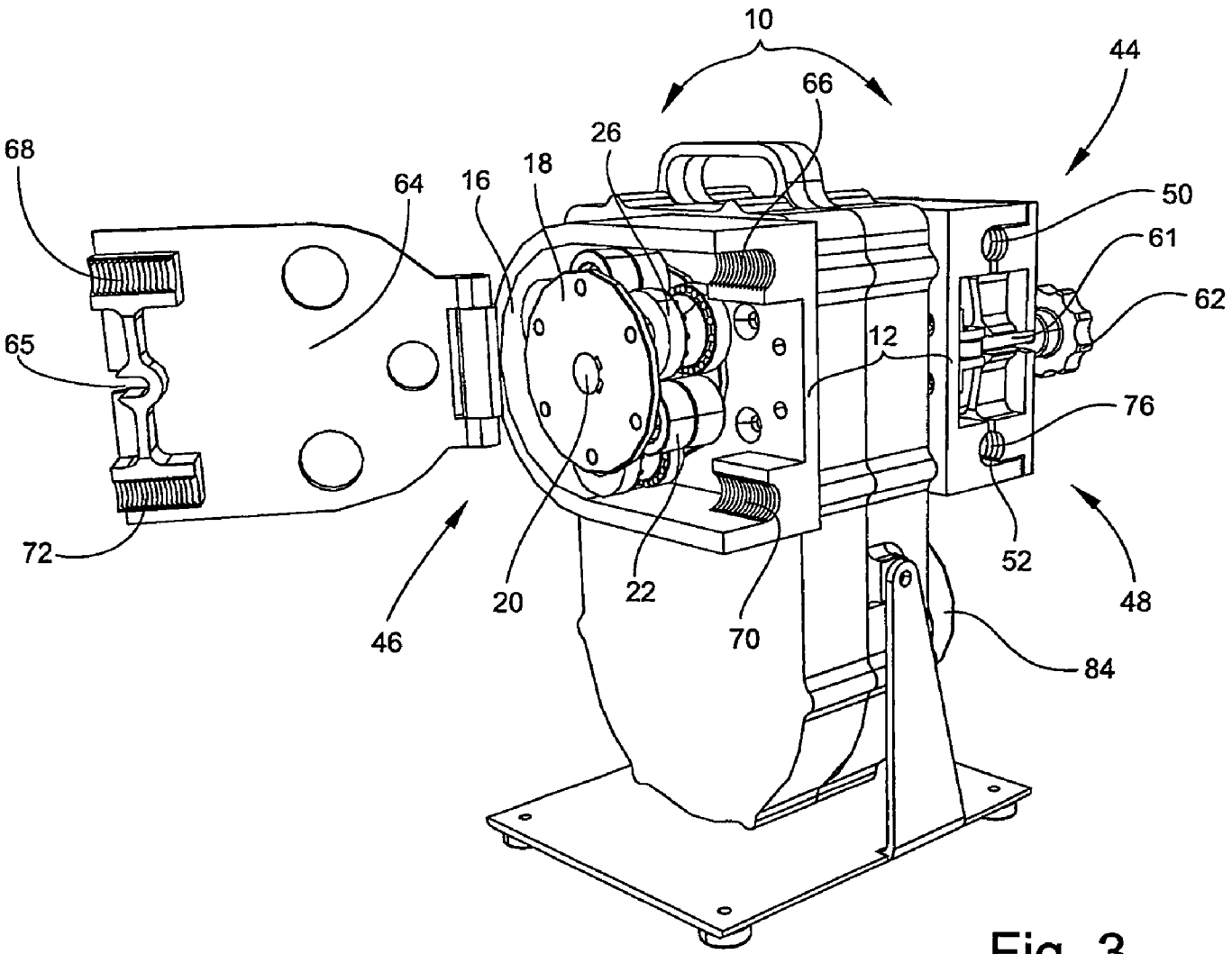
FIG. 3 is an isometric view of one embodiment of the peristaltic pump with two heads.
Figure 4:
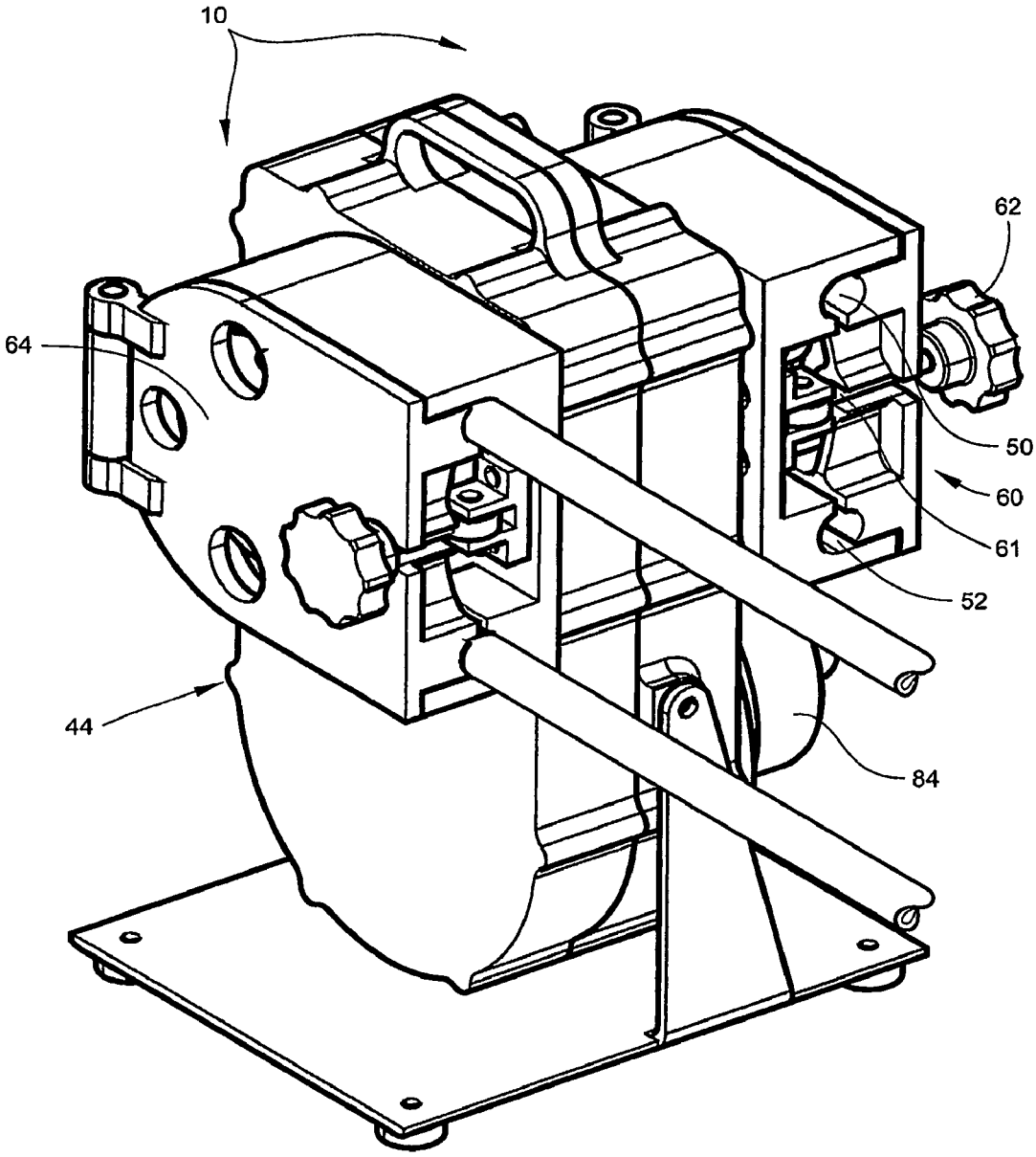
FIG. 4 is an isometric view of the embodiment in FIG. 3 of the peristaltic pump with two heads.

Referring to the drawings, wherein like numerals indicate like elements, there is shown in FIGS. 1, 3 and 4 a head 10 for a peristaltic pump which may be used in delivering ink to a flexographic printing press. The head 10 generally comprises a housing 12 and a roller assembly 18. Head 10 may be used for moving any fluid through a flexible tube 14. Head 10 may be used for moving an ink through flexible tube 14 for delivering ink to and from a flexographic printing press.

Housing 12 may be adapted to receive flexible tube 14 (see FIGS. 1 and 4). Housing 12 may be for housing roller assembly 18. Housing 12 may have a curved wall 16 (see FIG. 1). Housing 12 may be adapted to secure flexible tube 14 within housing 12. Housing 12 may include an entrance 50 and an exit 52 for receiving flexible tube 14 (see FIG. 1). Housing 12 may have a clamp 44 for securing flexible tube 14 within entrance 50 and exit 52 (see FIG. 4). Housing 12 may have an axis 20 that roller assembly 18 may rotate around (See FIG. 1). Housing 12 may have a hinged door 64 (See FIG. 3).

Flexible tube 14 may be inserted into housing 12 (See FIGS. 1 and 4). Flexible tube 14 may be for moving a liquid. Flexible tube 14 may be any flexible tube for moving a liquid. Flexible tube 14 may be inserted into entrance 50 around roller assembly 18 along curved wall 16 and out of exit 52. Flexible tube 14 may be automatically loaded into housing 12. Flexible tube 14 may be manually loaded into housing 12. Flexible tube 14 may be for delivering ink to and from a flexographic printing press.

Curved wall 16 may be a wall within housing 12 (see FIG. 1). Curved wall 16 may be for providing a smooth surface for roller assembly 18 to compress flexible tube 14 against.

Roller assembly 18 may be rotatable within housing 12 (see FIGS. 1 and 3). Roller assembly 18 may be for moving fluid through flexible tube 14 when roller assembly 18 may be rotated. Roller assembly 18 may be rotatable about axis 20. Roller assembly 18 may include at least two compression rollers 22. Roller assembly 18 may include at least one guide roller 26.

Axis 20 may be an axis through housing 12 (see FIGS. 1 and 3). Axis 20 may be for roller assembly 18 to rotate around. Axis 20 may be coaxial to curved wall 16.

At least two compression rollers 22 may be peripherally spaced on roller assembly 18 (see FIGS. 1 and 3). Compression rollers 22 may be for compressing flexible tube 14 against curved wall 16. Compression rollers 22 may be any rollers capable of compressing flexible tube 14 against curved wall 16. Compression rollers 22 may come successively into contact with flexible tube 14 and may confine a finite volume of fluid 24 in flexible tube 14 (see FIG. 1). Compression rollers 22 may rotate freely on roller assembly 18. A compression roller 22 may be a cylinder with a tapered perimeter that slopes toward the center of the cylinder (see FIG. 3). Compression rollers 22 may be made from any lightweight high quality material. Compression rollers 22 may be made from a polycarbonate material.

At least one guide roller 26 may be peripherally spaced between compression rollers 22 on roller assembly 18 (see FIGS. 1 and 3). There may be one guide roller 26 between every compression roller 22. Guide rollers 26 may come into contact with flexible tube 14 during rotation of roller assembly 18. Guide rollers 26 may be for centering flexible tube 14 on the compression rollers 22. Guide rollers 26 may be for initiating decompression of flexible tube 14 to return to a partial compression dimension 28 (see FIG. 1). Guide rollers 26 may be any structure for centering flexible tube 14 on compression rollers 22 or for initiating decompression of flexible tube 14 to return to the partial compression dimension 28. Guide rollers 26 may be for allowing flexible tube 14 to be automatically loaded into housing 12 by guiding flexible tube 14 from entrance 50 around roller assembly 18 and out of exit 52. Guide rollers 26 may be made from any light weight high quality material. Guide rollers 26 may be made from a polycarbonate material. Guide rollers 26 may be a cylinder that has a channel 30 (see FIG. 2).

Figure 2:
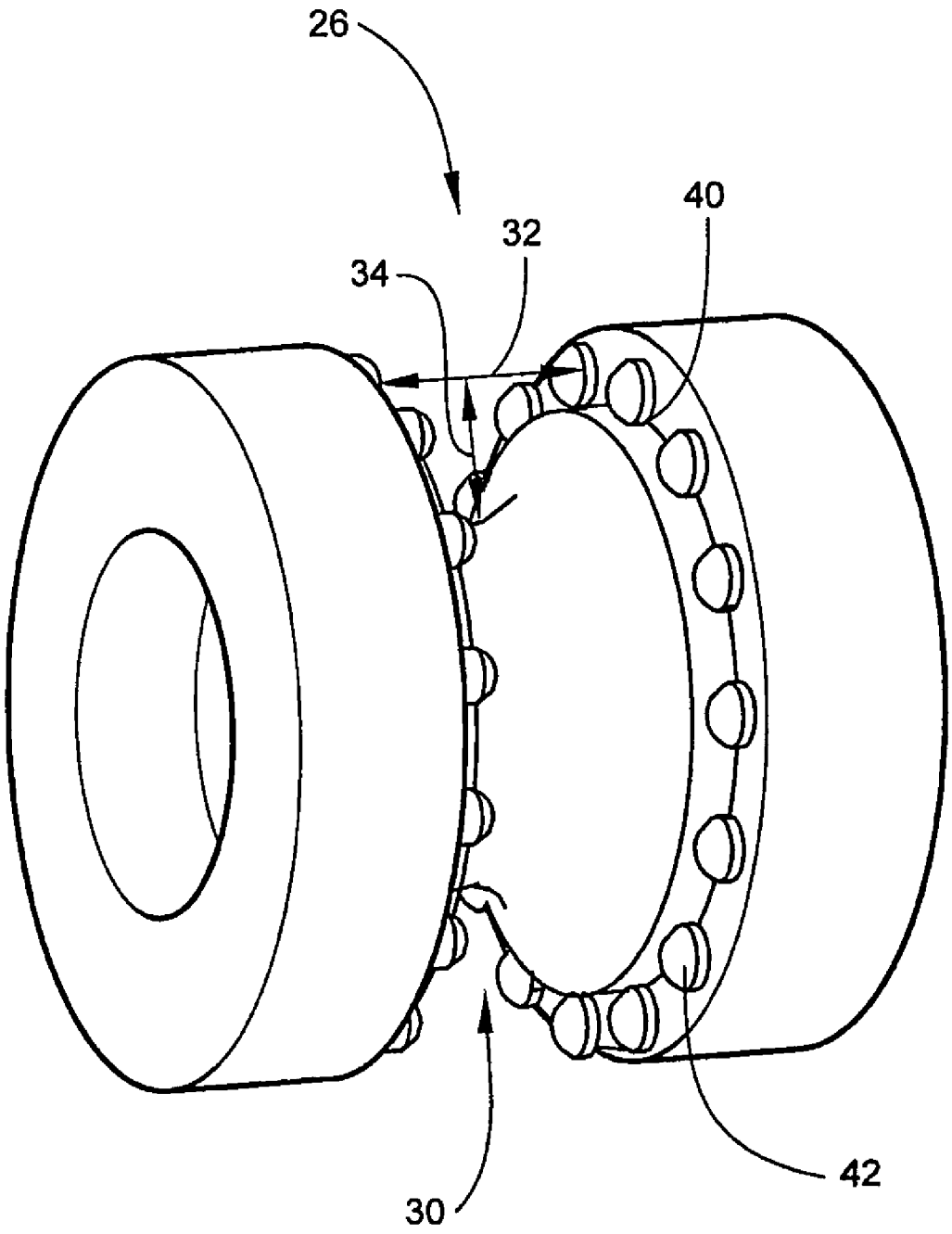
FIG. 2 is an isometric view of one of the guide rollers used in the embodiment in FIG. 1.

Channel 30 may be a channel within guide roller 26 (see FIG. 2). Channel 30 may be for centering flexible tube 14 with the compression rollers 22. Channel 30 may be centered in guide roller 26 which may guide flexible tube 14 to be centered with compression roller 22. Channel 30 may be for initiating decompression of flexible tube 14 to return to partial compression dimension 28. Channel 30 may have a width 32 and a depth 34. Channel 30 may include an anti-friction wall 40.

Width 32 may be the width of channel 30 (see FIG. 2). Width 32 may be for initiating decompression of flexible tube 14 to return to a width of the flexible tube 14 at partial compression dimension 28. Width 32 may be any width capable of initiating decompression of flexible tube 14 to return to a width of the flexible tube 14 at partial compression dimension 28. Width 32 may be the width of flexible tube 14 when flexible tube 14 is compressed fifty (50) percent.

Depth 34 may be the depth of channel 30 (see FIG. 2). Depth 34 may be for allowing flexible tube 14 to return to a height of the flexible tube 14 at partial compression dimension 28. Depth 34 may be any depth capable of allowing flexible tube 14 to return to a height of the flexible tube 14 at partial compression dimension 28. Depth 34 may be the height of flexible tube 14 when flexible tube 14 is compressed fifty (50) percent.

Partial compression dimension 28 may be the dimension of flexible tube 14 when guide rollers 26 may be rolling over it (see FIG. 1). Partial compression dimension 28 may be any dimension of flexible tube 14 when guide rollers 26 may be rolling over it. Partial compression dimension 28 may be the dimension of flexible tube 14 when flexible tube 14 may be fifty (50) percent compressed.

Anti-friction wall 40 may be on the wall of channel 30 (see FIG. 2). Anti-friction wall 40 may be for aiding guide roller 26 to roll over flexible tube 14. Anti-friction wall 40 may be any device for aiding guide rollers 26 to roll over flexible tube 14. Anti-friction wall 40 may be a row of bearings 42 on the wall of channel 30. The row of bearings 42 may be a row of ball roller bearings on the wall of channel 30. The row of bearings 42 may be a row of needle bearings on the wall of channel 30.

Clamp 44 may be located in housing 12 (See FIG. 3). Clamp 44 may be for securing flexible tube 14 within housing 12 (see FIGS. 1 and 4). Clamp 44 may be any device for securing flexible tube 14 within housing 12. Clamp 44 may have an open position 46 and a closed position 48. Clamp 44 may be in open position 46 when flexible tube 14 may move through entrance 50 and through exit 52. Clamp 44 may be in closed position 48 when a first section 56 of flexible tube 14 may be secured in entrance 50 where first section 56 may not be pulled into housing 12 but may gradually slip out of housing 12. Clamp 44 may be in closed position 48 when a second section 58 of flexible tube 14 may be secured in exit 52 where second section 58 may not be pulled into housing 12 but may gradually slip out of housing 12. Clamp 44 may be opened and closed by a fastener 60. Clamp 44 may be built into hinged door 64 of housing 12. Clamp 44 may include a first entrance gripping member 66 on housing 12. Clamp 44 may include a second entrance gripping member 68 on hinged door 64. Clamp 44 may include a first exit gripping member 70 on housing 12. Clamp 44 may include a second exit gripping member 72 on hinged door 64.

First entrance gripping member 66 may move with respect to second entrance gripping member 68 (see FIG. 3). First entrance gripping member 66 may come together with second entrance gripping member 68 when hinged door 64 may be closed to secure flexible tube 14 in entrance 50. First entrance gripping member 66 may come together with second entrance gripping member 68 to form entrance 50.

First exit gripping member 70 may move with respect to second exit gripping member 72 (see FIG. 3). First exit gripping member 70 may come together with second exit gripping member 72 when hinged door 64 may be closed to secure flexible tube 14 in exit 52. First exit gripping member 70 may come together with second exit gripping member 72 to form exit 52.

Entrance 50 may be a hole in housing 12 (see FIG. 1). Entrance 50 may be for allowing flexible tube 14 to move into and out of housing 12. Entrance 50 may have a serrated entrance wall 80.

Exit 52 may be a hole in housing 12 (see FIG. 1). Exit 52 may be for allowing flexible tube 14 to move into and out of housing 12. Exit 52 may have a serrated exit wall 81.

Serrated entrance wall 80 may be located within entrance 50 (see FIGS. 1 and 3). Serrated entrance wall 80 may be for securing first section 56 in entrance 50 where first section 56 may not be pulled into housing 12 but first section 56 may gradually slip out of housing 12. Serrated entrance wall 80 may be opened and closed by clamp 44. Serrated entrance wall 80 may be serrated at an entrance angle 82 (see FIG. 1).

Serrated exit wall 81 may be located within exit 52 (see FIGS. 1 and 3). Serrated exit wall 81 may be for securing second section 58 in exit 52 where second section 58 may not be pulled into housing 12 but second section 58 may gradually slip out of housing 12. Serrated exit wall 81 may be opened and closed by clamp 44. Serrated exit wall 81 may be serrated at an exit angle 83.

Entrance angle 82 may be the angle of the serrated teeth within serrated entrance wall 80 (see FIG. 1). Entrance angle 82 may be any angle where first section 56 may be secured in entrance 50 where first section 56 may not be pulled into housing 12 but first section 56 may gradually slip out of housing 12. Entrance angle 82 may be forty-five (45) degrees out of housing 12.

Exit angle 82 may be the angle of the serrated teeth within exit wall 81 (see FIG. 1). Exit angle 83 may be any angle where second section 58 may be secured in exit 52 where second section 58 may not be pulled into housing 12 but second section 58 may gradually slip out of housing 12. Exit angle 83 may be forty-five (45) degrees out of housing 12.

Entrance angle 82 may be equal to exit angle 83 allowing head 10 to move fluid in both directions (see FIG. 1). Entrance angle 82 and exit angle 83 may be forty-five (45) degrees out of housing 12.

Hinged door 64 may be a hinged door on housing 12 capable of opening and closing (see FIG. 3). Hinged door 64 may be for opening head 10 for maintenance. Hinged door 64 may be included in clamp 44. Hinged door 64 may include second entrance gripping member 68. Hinged door 64 may include second exit gripping member 72. Hinged door 64 may include slot 65.

Fastener 60 may be included in clamp 44 (see FIG. 4). Fastener 60 may be for opening and closing clamp 44. Fastener 60 may open and close clamp 44 without using tools. Fastener 60 may be any device for opening and closing clamp 44 without using tools. Fastener 60 may include a hinged bar 61 fixed to housing 12 that may be rotated in and out of slot 65 on hinged door 64. Fastener 60 may include a hand knob 62 for opening and closing clamp 44 and hinged door 64.

Hinged bar 61 may be secured to housing 12. Hinged bar 61 may be for opening and closing clamp 44 and hinged door 64. Hinged bar 61 may be a bar secured to housing 12 where it may be rotated in and out of slot 65 on hinged door 64. Hinged gar 61 may include hand knob 62

Hand knob 62 may be included in clamp 44 (see FIGS. 3 and 4). Hand knob 62 may be for opening and closing clamp 44 and hinged door 64 without using tools. Hand knob 62 may open clamp 44 by manually rotating hand knob 62 counterclockwise where entrance 50 and exit 52 may be loosened. Hand knob 62 may close clamp 44 by manually rotating hand knob 62 clockwise when hinged bar 61 may be in slot 65 where entrance 50 and exit 52 may be tightened. Hand knob 62 may open hinged door 64 by rotating counterclockwise and rotating hinged bar 61 out of slot 65 where hinged door 64 may be opened. Hand knob 62 may close hinged door 64 by rotating hinged bar 61 into slot 65 and rotating hand knob 62 clockwise.

Figure 5:
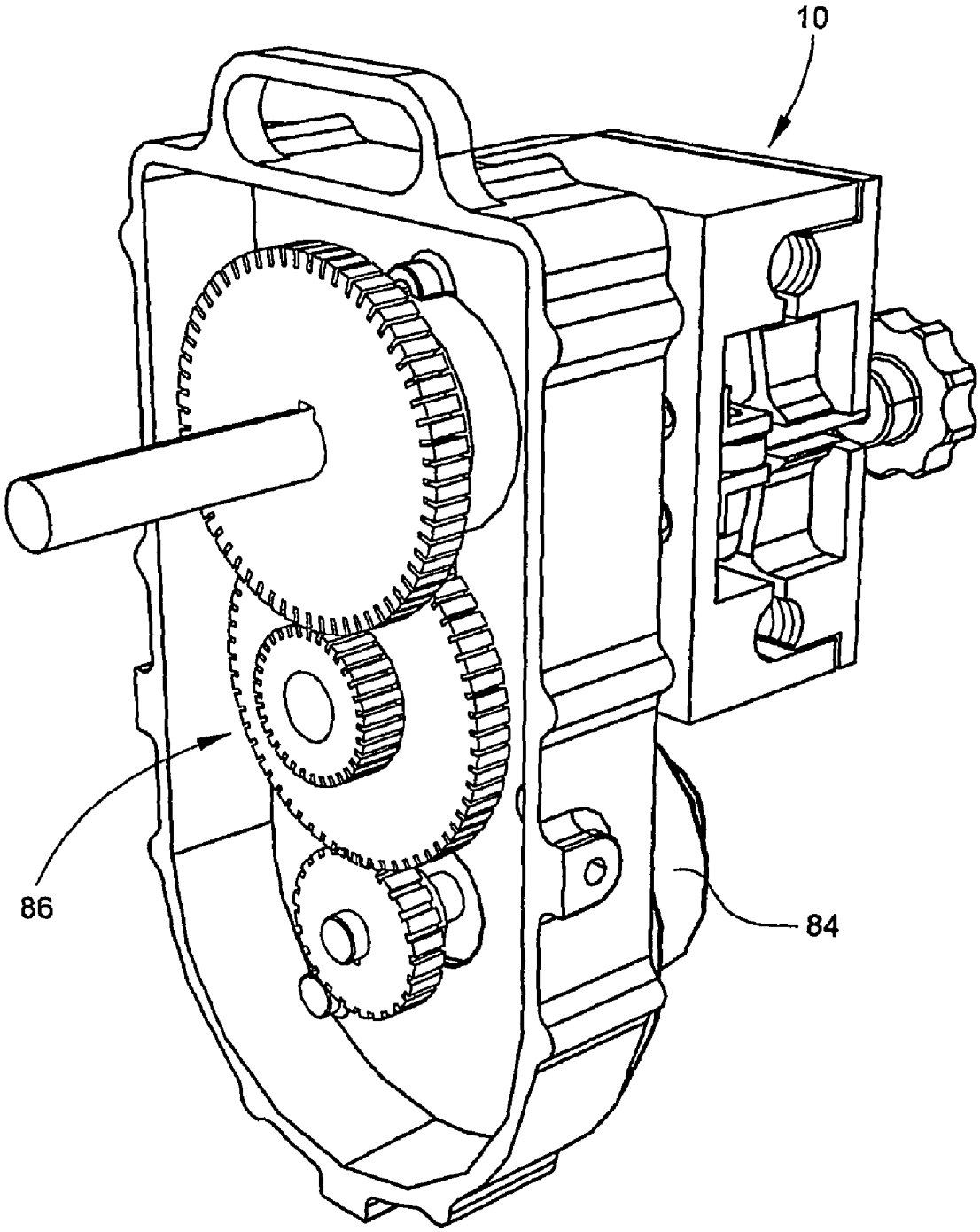
FIG. 5 is an isometric view of one embodiment of the gear system connecting the motor to the head.

A motor 84 may force roller assembly 18 to rotate (see FIGS. 3-5). Motor 84 may be any motor capable of rotating roller assembly 18. Motor 84 may be powered by electricity. Motor 84 may be powered by air. Motor 84 may be linked to roller assembly 18 through a system of gears 86. Motor 84 may be side mounted on the peristaltic pump. Motor 84 may be together in one unit with one head 10 or multiple heads 10 and system of gears 86.

The system of gears 86 may link motor 84 to roller assembly 18 (see FIG. 5). System of gears 86 may be any system of gears capable of linking roller assembly 18 to motor 84. System of gears 86 may allow motor 84 to be side mounted on the peristaltic pump. System of gears 86 may be in one unit with one head 10 or multiple heads 10 and motor 84. System of gears 86 may allow motor 84 to be powered by electricity or air without requiring an adapter.

Before operation, flexible tube 14 may be loaded into head 10 (shown in FIGS. 1 and 4). Flexible tube 14 may be loaded into head 10 automatically by opening clamp 44 to open position 46 (hinged door 64 does not have to be opened as shown in FIG. 3 for clamp 44 to be opened) by rotating hand knob 62 counter clockwise and inserting flexible tube 14 into housing 12 through entrance 50. Roller assembly 18 may be rotated counterclockwise (as shown in FIG. 1) and guide rollers 26 may guide flexible tube 14 from entrance 50 around roller assembly 18 and out of housing 12 from exit 52. Hand knob 62 may be rotated clockwise where clamp 44 may secure flexible tube 14 in housing 12. Guide rollers 26 in combination with hand knob 62 may allow flexible tube 14 to be inserted without having to use tools.

In operation, once flexible tube 14 may be loaded and a fluid may be introduced to one end of flexible tube 14, roller assembly 18 may be rotated within housing 12 forcing fluid through flexible tube 14. Fluid may be forced through flexible tube 14 by two successive compression rollers 22. The successive compression rollers 22 may compress two portions of flexible tube 14 against curved wall 16 to confine a finite volume of fluid 24 in flexible tube 14 (see FIG. 1). When roller assembly 18 rotates, finite volume of fluid 24 rotates from one end of curved wall 16 to the other end of curved wall 16 forcing fluid from one end of flexible tube 14 to the other end of flexible tube 14.

After each successive compression, guide rollers 26 between successive compression rollers 22 may initiate decompression of flexible tube 14 to return to partial compression dimension 28. Fluid may be induced into flexible tube 14 when flexible tube 14 may return to partial compression dimension 28 providing the positive displacement to flexible tube 14. Channel 30 may fit over flexible tube 14 while rotating where width 32 may initiate decompression of flexible tube 14 and depth 34 may allow flexible tube 14 to return to a dimension of fifty (50) percent compression. Flexible tube 14 may last longer when decompression is initiated on flexible tube 14 to return to a dimension of fifty (50) percent compression between each successive compression because this may reduce the fatigue on the edges of flexible tube 14.

After each successive compression, guide rollers 26 between successive compression rollers 22 may also guide flexible tube 14 to stay centered with successive compression rollers 22 while roller assembly 18 may be rotated. Channel 30 may fit over flexible tube 14 while rotating. The width 32 may be centered horizontally with the compression rollers 22 which may guide flexible tube 14 to stay centered horizontally with compression rollers 22. The depth 34 may be a depth that is centered on a circular path with the compression rollers 22 which may guide flexible tube 14 to stay centered on a circular path with compression rollers 22 while rotating. Flexible tube 14 staying centered horizontally and on a circular path with compression rollers 22 may prevent flexible tube 14 from creeping off center from compression rollers 22. Keeping flexible tube 14 from creeping off center may reduce the fatigue on flexible tube 14 which may extend the life of flexible tube 14.

While guide rollers 26 move over flexible tube 14, anti-friction wall 40 within channel 30 may aid guide rollers 26 over flexible tube 14. Anti-friction wall 40 may prevent guide rollers 26 from wearing down flexible tube 14 or may reduce the fatigue on flexible tube 14. Reducing the fatigue on flexible tube 14 may extend the life of flexible tube 14.

While compression rollers 22 may rotate within housing 12, compression rollers 22 may stretch flexible tube 14 in the direction roller assembly 18 may be rotating. When roller assembly 18 may be rotating counterclockwise (as shown in FIG. 1) moving fluid from entrance 50 to exit 52, serrated entrance wall 80 in entrance 50 may secure first section 56 within entrance 50. Because entrance angle 82 may be forty-five (45) degrees out of housing 12, first section 56 may not be pulled into housing 12 while compression rollers 22 roll over flexible tube 14. Serrated exit wall 81 in exit 52 may secure second section 58 within exit 52. Because flexible tube 14 may be stretched in the direction roller assembly 18 may be rotating and exit angle 83 may be forty-five (45) degrees out of housing 12, second section 58 may gradually slip out of housing 12 while compression rollers 22 roll over flexible tube 14. Because second section 58 may gradually slip out of housing 12, flexible tube 14 may not bunch or gather before exit 52, which may reduce the fatigue on flexible tube 14 and may prevent flexible tube 14 from rupturing over long periods of use.

Head 10 may be reversible because entrance angle 82 and exit angle 83 may be equal out of housing 12. This may allow roller assembly 18 to rotate clockwise (as shown in FIG. 1) moving fluid from exit 52 to entrance 50. When roller assembly 18 may rotate clockwise, serrated exit wall 81 in exit 52 may secure second section 58 within exit 52. Because exit angle 83 may be forty-five (45) degrees out of housing 12, second section 58 may not be pulled into housing 12 while compression rollers 22 roll over flexible tube 14. Serrated entrance wall 80 of entrance 50 may secure first section 56 within entrance 50. Because flexible tube 14 may stretch in the direction roller assembly 18 may be rotating and entrance angle 82 may be forty-five (45) degrees out of housing 12, first section 56 may gradually slip out of housing 12 while compression rollers 22 roll over flexible tube 14. Because first section 56 may gradually slip out of housing 12, flexible tube 14 may not bunch or gather before entrance 50, which may reduce the fatigue on flexible tube 14 and may prevent flexible tube 14 from rupturing over long periods of use.

Compression rollers 22 and guide rollers 26 may be made from a lightweight high quality material like polycarbonate material. Because they may be made out of a polycarbonate material, head 10 may be designed so that it may be lighter and may last longer than current peristaltic heads. This means that head 10 may be lighter, may be more operator friendly, and may require less maintenance than the current peristaltic pump heads.

Motor 84, system of gears 86 and two (2) heads 10 may come together in one body as one unit (see FIG. 4). This may allow a peristaltic pump with two (2) heads 10 that may pump two different lines of fluid in both directions. The body may be made out of all metal parts. This may allow for a complete peristaltic pump requiring no assembly that is easy to manufacture and maintain and is simple, versatile, durable, cheap and provides for easy servicing.

The present invention may be embodied in other forms without departing from the spirit and the essential attributes thereof, and, accordingly, reference should be made to the appended claims, rather than to the foregoing specification, as indicated in the scope of the invention.

We claim:

1. A head for a peristaltic pump comprising:

a housing being adapted to receive a flexible tube having a curved wall;

said housing being adapted to secure said flexible tube within said housing;

a roller assembly being rotatable within said housing about an axis through said housing;

said axis being coaxial to said curved wall;

said roller assembly comprising:

at least two compression rollers being peripherally spaced where each of said compression rollers coming successively into contact with said flexible tube during rotation of said roller assembly with successive compression rollers being operative to compress two portions of said flexible tube against said curved wall to confine a finite volume of fluid in said flexible tube;

at least one guide roller being peripherally spaced between said compression rollers where each of said guide rollers coming into contact with said flexible tube during rotation of said roller assembly with said guide rollers being operative to guide said flexible tube to stay centered with said compression rollers and being operative to initiate decompression of said flexible tube to return to a partial compression dimension;

said guide rollers having a channel with a width and a depth;

said width being centered on said guide rollers guiding said flexible tube to stay centered with said compression rollers on a horizontal plane; and said depth guiding said flexible tube to stay centered with said compression rollers on a circular path;

said width being the width of said flexible tube at said partial compression dimension initiating decompression of said flexible tube to return to said partial compression dimension and said depth being the height of said flexible tube at said partial compression dimension allowing said flexible tube to return to said partial compression dimension;

a wall of said channel including an anti-friction wall, said anti-friction wall aiding said guide rollers to move over said flexible tube;

said anti-friction wall being a row of bearings peripherally spaced on the wall of said channel;

whereby fluid may be moved through said flexible tube by rotation of said roller assembly.

2. The head of claim 1 where the number of said guide rollers being equal to the number of said compression rollers, where one guide roller being peripherally spaced between every compression roller.

3. The head of claim 1 where said row of bearings being ball roller bearings.

4. The head of claim 1 where said partial compression dimension being the width of said flexible tube when said flexible tube being compressed fifty (50) percent.

5. The head of claim 1 where said housing being adapted to load said flexible tube, whereby when said flexible tube being inserted into an entrance and said roller assembly being rotated, said guide rollers guiding said flexible tube around said roller assembly and out of an exit.

6. A head for a peristaltic pump comprising:

a housing being adapted to receive a flexible tube;

said housing comprising:

a curved wall;

a clamp being operable to secure said flexible tube within said housing;

said clamp being in an open position when said flexible tube being able to move through an entrance in said housing and said flexible tube being able to move through an exit in said housing;

said clamp being in a closed position where a first section of said flexible tube being secured in said entrance and a second section of said flexible tube being secured in said exit where said first and second sections not being able to be pulled into said housing but being able to gradually slip out of said housing preventing said flexible tube from bunching in said housing;

said clamp being built into a hinged door of said housing, where said clamp comprises:

a first entrance gripping member attached to said housing;

a second entrance gripping member attached to said hinged door;

said first and second entrance gripping members being movable relative to one another where said entrance gripping members come together to form said entrance and secure said first section of said flexible tube in said entrance;

a first exit gripping member attached to said housing;

a second exit gripping member attached to said hinged door; and said first and second exit gripping members being movable relative to one another where said exit gripping members come together to form said exit and secure said second section of said flexible tube in said exit;

a roller assembly being rotatable within said housing about an axis through said housing;

said axis being coaxial to said curved wall;

said roller assembly comprising:

at least two compression rollers being peripherally spaced where each of said compression rollers coming successively into contact with said flexible tube during rotation of said roller assembly with successive compression rollers being operative to compress two portions of said flexible tube against said curved wall to confine a finite volume of fluid in said flexible tube;

at least one guide roller being peripherally spaced between said compression rollers where each of said guide rollers coming into contact with said flexible tube during rotation of said roller assembly with said guide rollers being operative to guide said flexible tube to stay centered with said compression rollers and being operative to initiate decompression of said flexible tube to return to a partial compression dimension;

said guide rollers having a channel with a width and a depth;

said width being centered on said guide rollers guiding said flexible tube to stay centered with said compression rollers on a horizontal plane; and said depth guiding said flexible tube to stay centered with said compression rollers on a circular path;

said width being the width of said flexible tube at said partial compression dimension initiating decompression of said flexible tube to return to said partial compression dimension and said depth being the height of said flexible tube at said partial compression dimension allowing said flexible tube to return to said partial compression dimension;

a wall of said channel including an anti-friction wall, said anti-friction wall aiding said guide rollers to move over said flexible tube;

said anti-friction wall being a row of bearings peripherally spaced on the wall of said channel;

whereby fluid may be moved through said flexible tube by rotation of said roller assembly.

7. The head of claim 6 where the number of said guide rollers being equal to the number of said compression rollers, where one guide roller being peripherally spaced between every compression roller.

8. The head of claim 6 where said row of bearings being ball roller bearings.

9. The head of claim 6 where said partial compression dimension being said flexible tube when said flexible tube being compressed fifty (50) percent.

10. The head of claim 6 where said clamp being able to open and close by a fastener.

11. The head of claim 10 where said fastener including a hand knob.

12. The head of claim 6 where said clamp includes a serrated entrance wall capable of being opened and closed in said entrance and a serrated exit wall capable of being opened and closed in said exit.

13. The head of claim 12 where said serrated entrance wall being serrated at an entrance angle and said serrated exit wall being serrated at an exit angle.

14. The head of claim 13 where said entrance angle being equal to said exit angle allowing the head to move liquid through said flexible tube in both directions.

15. The head of claim 14 where said entrance angle and said exit angle being forty-five (45) degrees out of said housing.

16. The head of claim 6 where said housing being adapted to load said flexible tube, whereby when said clamp being open and said flexible tube being inserted into said entrance, said roller assembly being rotated where said guide rollers guiding said flexible tube around said roller assembly and out of said exit.

17. A method for pumping ink to and from a printing section of a printing press using a pump with at least one head, said head comprising:

a housing being adapted to receive a flexible tube having a curved wall;

said housing being adapted to secure said flexible tube within said housing;

a roller assembly being rotatable within said housing about an axis through said housing;

said axis being coaxial to said curved wall;

said roller assembly comprising:

at least two compression rollers being peripherally spaced where each of said compression rollers coming successively into contact with said flexible tube during rotation of said roller assembly with successive compression rollers being operative to compress two portions of said flexible tube against said curved wall to confine a finite volume of ink in said flexible tube;

at least one guide roller being peripherally spaced between said compression rollers where each of said guide rollers coming successively into contact with said flexible tube during rotation of said roller assembly with successive guide rollers being operative to guide said flexible tube to stay centered with said compression rollers and being operative to initiate decompression of said flexible tube to return to a partial compression dimension;

said guide rollers having a channel with a width and a depth;

said width being centered on said guide rollers guiding said flexible tube to stay centered with said compression rollers on a horizontal plane; and said depth guiding said flexible tube to stay centered with said compression rollers on a circular path;

said width being the width of said flexible tube at said partial compression dimension initiating decompression of said flexible tube to return to said partial compression dimension and said depth being the height of said flexible tube at said partial compression dimension allowing said flexible tube to return to said partial compression dimension;

a wall of said channel including an anti-friction wall, said anti-friction wall aiding said guide rollers to move over said flexible tube;

said anti-friction wall being a row of bearings peripherally spaced on the wall of said channel;

whereby fluid may be moved through said flexible tube by rotation of said roller assembly.

18. A method for pumping ink to and from a printing section of a printing press using a pump with at least one head, said head comprising:

a housing being adapted to receive a flexible tube;

said housing comprising:

a curved wall;

a clamp being operable to secure said flexible tube within said housing;

said clamp being in an open position when said flexible tube being able to move through an entrance in said housing and said flexible tube being able to move through an exit in said housing;

said clamp being in a closed position where a first section of said flexible tube being secured in said entrance and a second section of said flexible tube being secured in said exit where said first and second sections not being able to be pulled into said housing but being able to gradually slip out of said housing preventing said flexible tube from bunching in said housing;

said clamp being built into a hinged door of said housing, where said clamp comprising:

a first entrance gripping member attached to said housing;

a second entrance gripping member attached to said hinged door;

said first and second entrance gripping members being movable relative to one another where said entrance gripping members come together to form said entrance and secure said first section of said flexible tube in said entrance;

a first exit gripping member attached to said housing;

a second exit gripping member attached to said hinged door; and said first and second exit gripping members being movable relative to one another where said exit gripping members come together to form said exit and secure said second section of said flexible tube in said exit;

a roller assembly being rotatable within said housing about an axis through said housing;

said axis being coaxial to said curved wall;

said roller assembly comprising:

at least two compression rollers being peripherally spaced where each of said compression rollers coming successively into contact with said flexible tube during rotation of said roller assembly with successive compression rollers being operative to compress two portions of said flexible tube against said curved wall to confine a finite volume of ink in said flexible tube;

at least one guide roller being peripherally spaced between said compression rollers where each of said guide rollers coming successively into contact with said flexible tube during rotation of said roller assembly with successive guide rollers being operative to guide said flexible tube to stay centered with said compression rollers and being operative to initiate decompression of said flexible tube to return to a partial compression dimension;

said guide rollers having a channel with a width and a depth;

said width being centered on said guide rollers guiding said flexible tube to stay centered with said compression rollers on a horizontal plane; and said depth guiding said flexible tube to stay centered with said compression rollers on a circular path;

said width being the width of said flexible tube at said partial compression dimension initiating decompression of said flexible tube to return to said partial compression dimension and said depth being the height of said flexible tube at said partial compression dimension allowing said flexible tube to return to said partial compression dimension;

a wall of said channel including an anti-friction wall, said anti-friction wall aiding said guide rollers to move over said flexible tube;

said anti-friction wall being a row of bearings peripherally spaced on the wall of said channel;

whereby fluid may be moved through said flexible tube by rotation of said roller assembly.

* * * * *

UNITED STATES PATENT AND TRADEMARK OFFICE

CERTIFICATE OF CORRECTION

PATENT NO. : 7,918,657 B2
APPLICATION NO. : 11/909182
DATED : April 5, 2011
INVENTOR(S) : Marion H. Bobo and Michael M. Brown It is certified that error appears in the above-identified patent and that said Letters Patent is hereby corrected as shown below:

On title page, item 54 and col. 1, lines 1-3, Correction to Title,
replace "HEAD FOR A PERISTALTIC PUMP WITH GUIDE AND ROLLER CLAMP ARRANGEMENT"
with "HEAD FOR A PERISTALTIC PUMP WITH GUIDE ROLLER AND CLAMP ARRANGEMENT"

Signed and Sealed this
Thirty-first Day of May, 2011

David J. Kappos

David J. Kappos
*Director of the United States Patent and Trademark Office*